US007534972B2

(12) United States Patent
Tan

(10) Patent No.: US 7,534,972 B2
(45) Date of Patent: May 19, 2009

(54) ELECTRICAL SWITCH

(75) Inventor: Jun-Ming Tan, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 112 days.

(21) Appl. No.: 11/827,269

(22) Filed: Jul. 11, 2007

(65) Prior Publication Data

US 2008/0047808 A1 Feb. 28, 2008

(51) Int. Cl.
*H01H 9/06* (2006.01)

(52) U.S. Cl. ..... 200/1 R; 200/332.2

(58) Field of Classification Search ..... 200/310–345, 200/332.2, 61.47, 537; 400/490
See application file for complete search history.

*Primary Examiner*—Michael A Friedhofer
*Assistant Examiner*—Lisa N Klaus
(74) *Attorney, Agent, or Firm*—Wei Te Chung

(57) ABSTRACT

An electrical switch includes a housing (1) with a cavity, a plurality of stationary contacts (2) embedded in the housing, a metal dome (3) received in the cavity, a handle (4) disposed onto the metal dome, and a cover (5) mounted onto the housing. The stationary contacts include a central stationary contact (231) and a plurality of peripheral stationary contacts (221), and the dome includes an arcuate central portion (31) covering the central stationary contact and a circular side portion (32) contacting with the peripheral stationary contacts. The handle defines a connecting portion (443), the connecting portion is apart from the dome during operation of the handle.

14 Claims, 9 Drawing Sheets

ELECTRICAL SWITCH

BACKGROUND OF THE INVENTION

1. Field of the Invention

The present invention generally relates to the field of electrical switch. And more particularly, one embodiment of the invention relates to an electrical switch used in various electronic devices such as portable telephones and digital cameras.

2. General Background

Electrical switches are widely used in various electrical devices. Referring to FIGS. 6-9, the traditional electrical switch comprises a housing 1', a plurality of stationary contacts 2' fixed in the housing 1', a dome 3' with an arcuate center portion covering a center stationary contacts 231' and a circular side portion slightly contacting with some peripheral stationary contacts 221', a handle 4' disposed onto the dome 3', and a cover 5' with a center opening 511' mounted onto the housing 1'.

The handle 4' comprises a top operating portion 41', a lower pressing portion 42' for pressing the dome 3', and a middle portion 44' for connecting the operating portion 41' and the pressing portion 42'. The middle portion 44' defines a cylinder-shaped configuration, and it defines a top surface 444' and a corresponding lower surface 441'. The pressing portion 42' extends from a center of said lower surface 441' for pressing the arcuate center portion of the dome 3'. When the arcuate center portion of the dome 3' is pressed down, the dome 3' contacts with the center stationary contacts 231'. Therefore, the center stationary contact 231' connects with the peripheral stationary contacts 221' through the dome 3', and corresponding connecting function of the switch is achieved.

However, one problem with this electrical switch is that when the operation portion 41' is accidentally pressed at one side thereof, the whole handle 4' will slant to one side, and corresponding outer edge of the lower surface 441' of the middle portion 44' will undesirably contact with the dome 3'. The undesirable contact will create undesirable operation sense, which may misguide the operator.

Therefore, an improved electrical switch is desired to overcome the aforementioned deficiencies and inadequacies.

SUMMARY

According to an embodiment of the present invention, an electrical switch comprises a housing with a cavity, a plurality of stationary contacts embedded in the housing, a metal dome received in the cavity, a handle disposed onto the metal dome, and a cover mounted onto the housing. The stationary contacts comprise a central stationary contact and a plurality of peripheral stationary contacts, and the dome includes an arcuate central portion covering the central stationary contact and a circular side portion contacting with the peripheral stationary contacts. The handle defines a connecting portion, the connecting portion slants upwardly from side of the lower surface for avoiding interfering with the dome during operation of the handle.

The present invention is illustrated by way of example and not limitation in the figures of the appended drawings, in which like references indicate identical elements, and in which:

DETAILED DESCRIPTION OF THE EMBODIMENT

Figure 1:
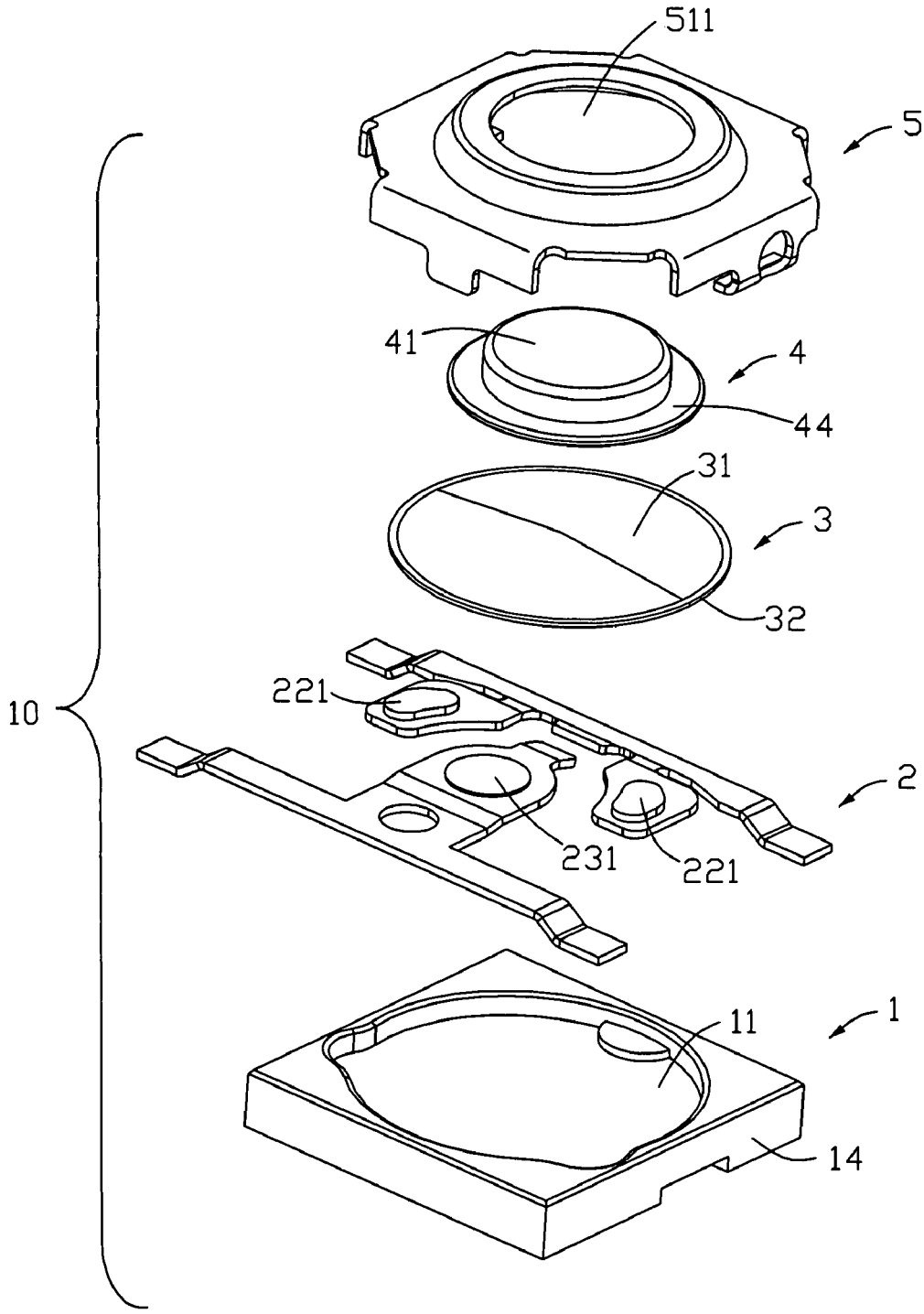
FIG. 1 is an exemplary exploded, isometric view of an electrical switch in accordance with an embodiment of the present invention.

In the following detailed description, for purposes of explanation, numerous specific details are set forth in order to provide a thorough understanding of the embodiment of the present invention. It will be apparent, however, that the present invention may be practiced without these specific details. In other instances, well-known structures and devices are schematically shown in order to simplify the drawing.

Figure 2:
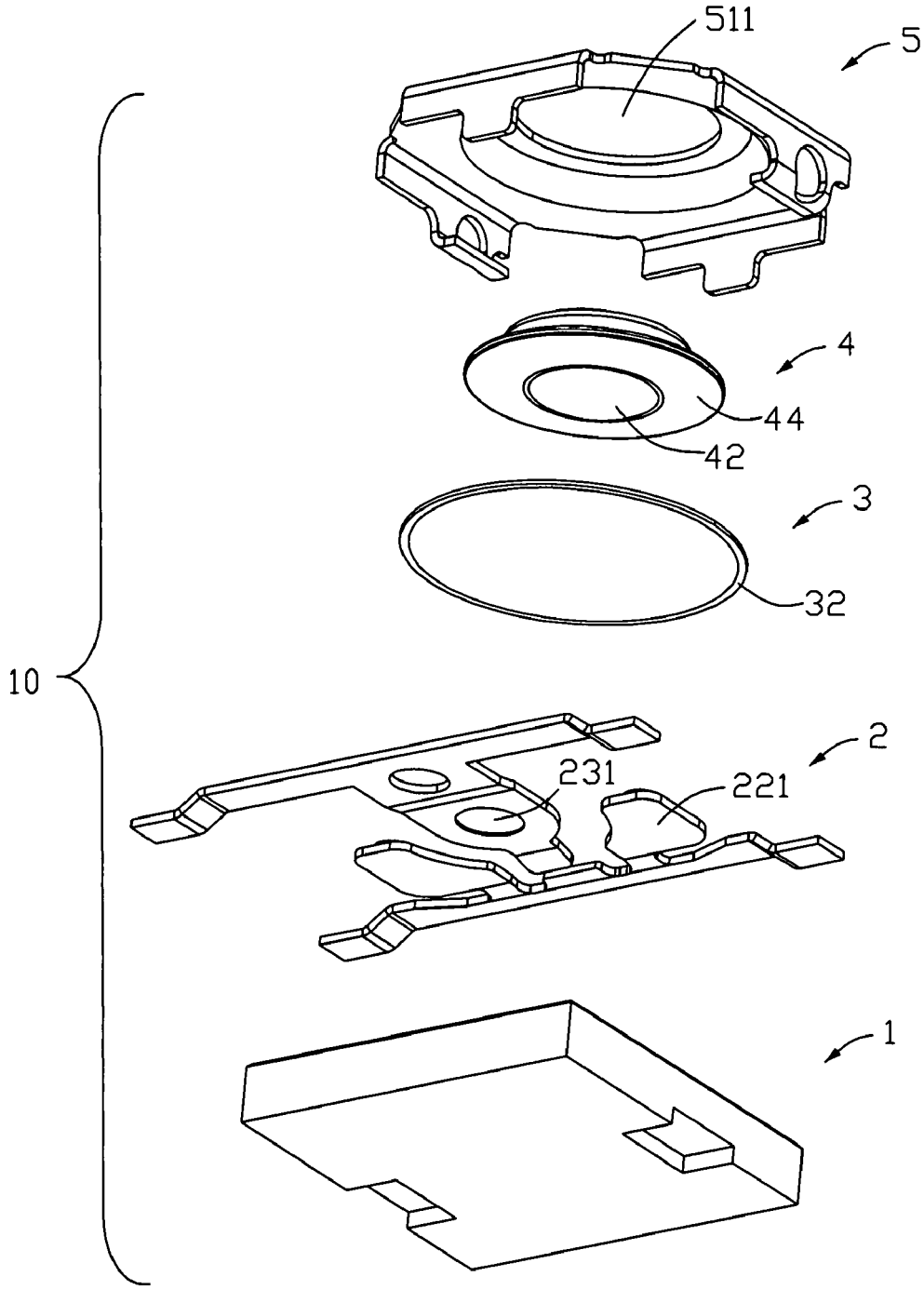
FIG. 2 is another exploded, isometric view of the electrical switch as shown in FIG. 1.
Figure 3:
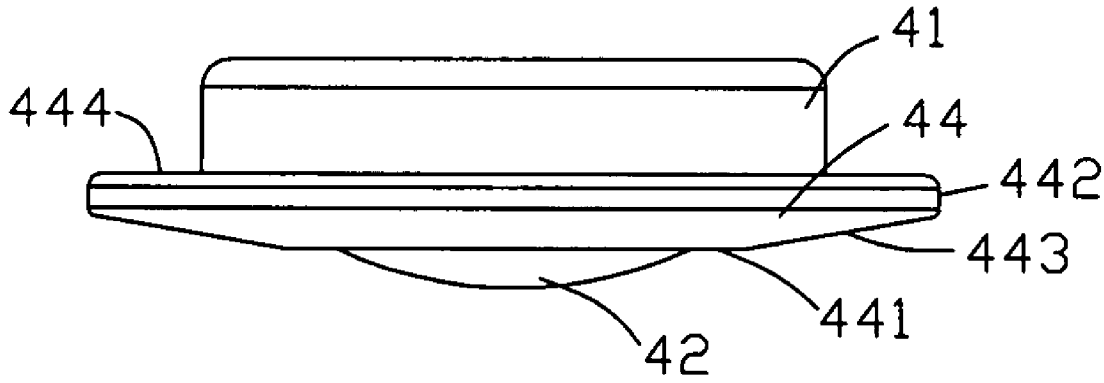
FIG. 3 is an isometric view of a handle of the electrical switch.
Figure 4:
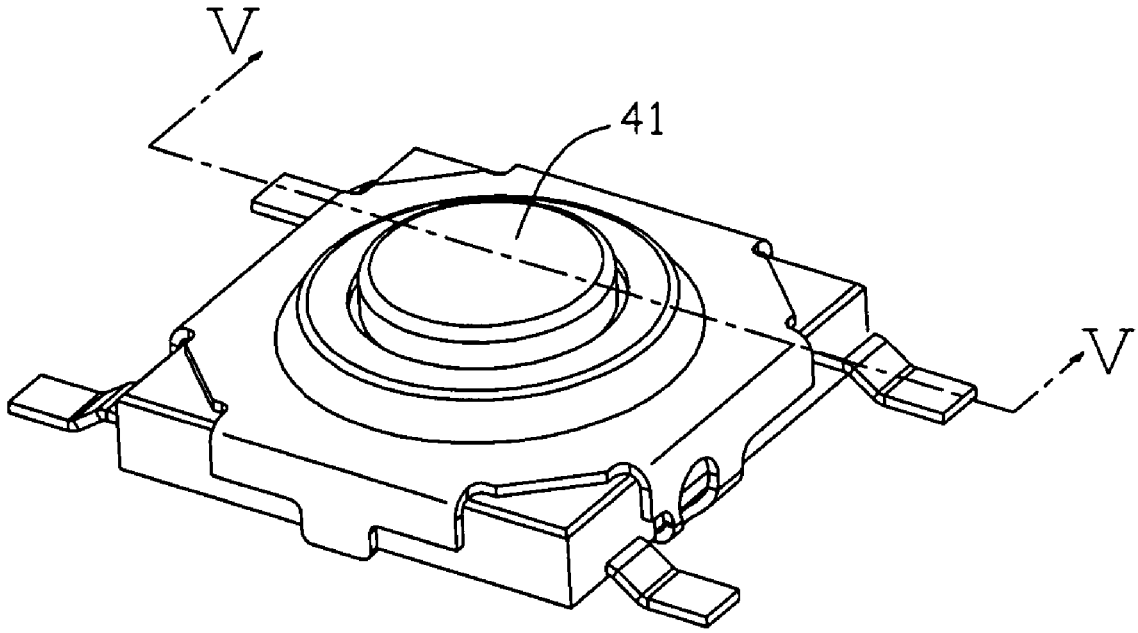
FIG. 4 is an exemplary assembled, isometric view of the electrical switch as shown in FIG. 1.
Figure 5:
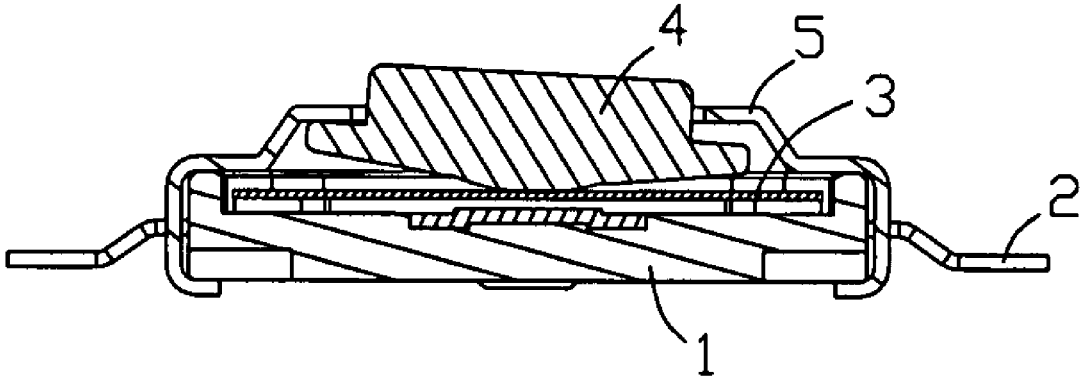
FIG. 5 is a cross-sectional view of the assembled electrical switch shown in FIG. 4.
Figure 6:
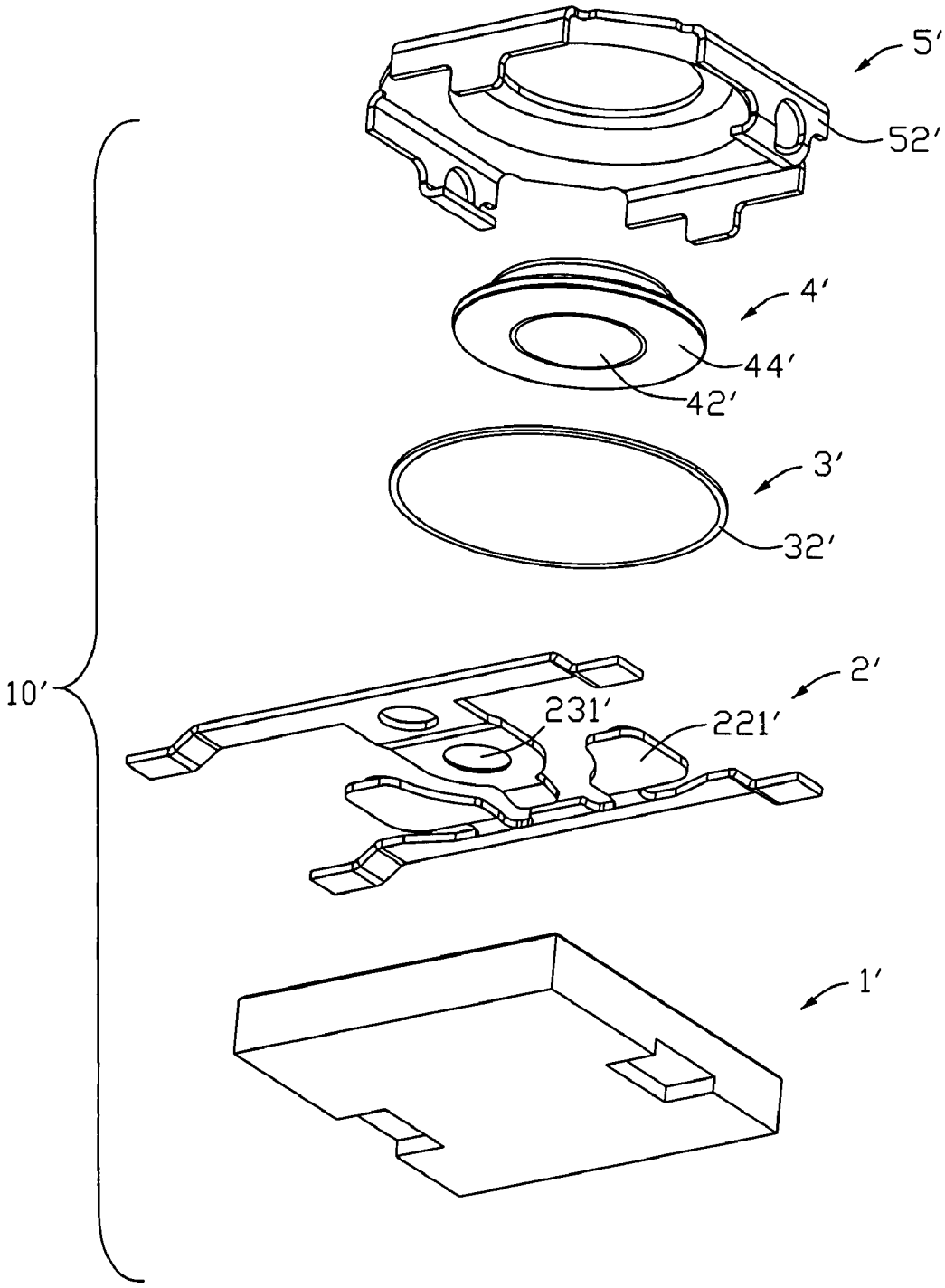
FIG. 6 is an exploded, isometric view of a conventional electrical switch.
Figure 7:
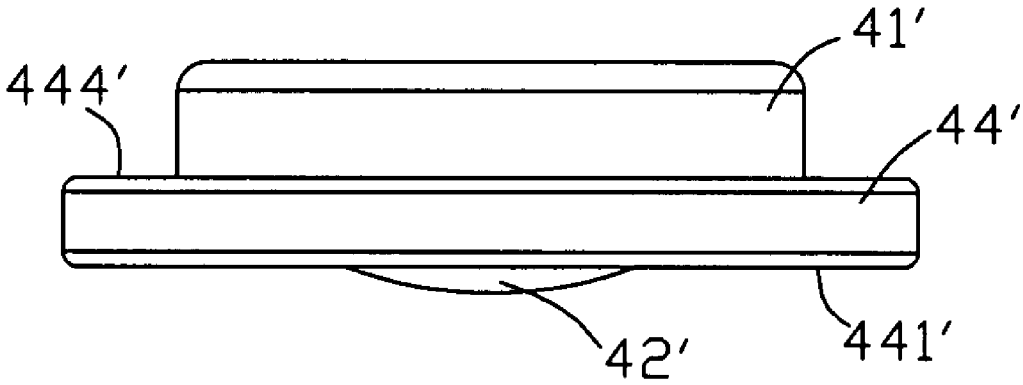
FIG. 7 is an isometric view of a handle of the conventional electrical switch as shown in FIG. 6.
Figure 8:
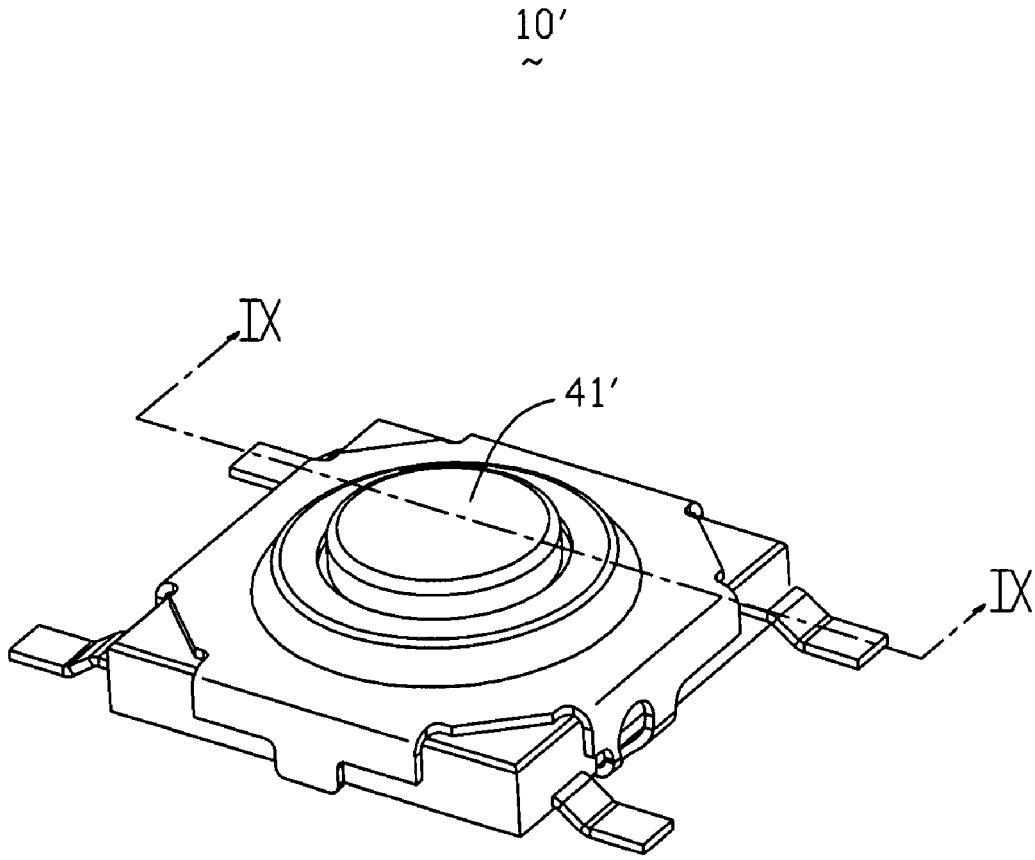
FIG. 8 is an assembled, isometric view of the conventional electrical switch.
Figure 9:
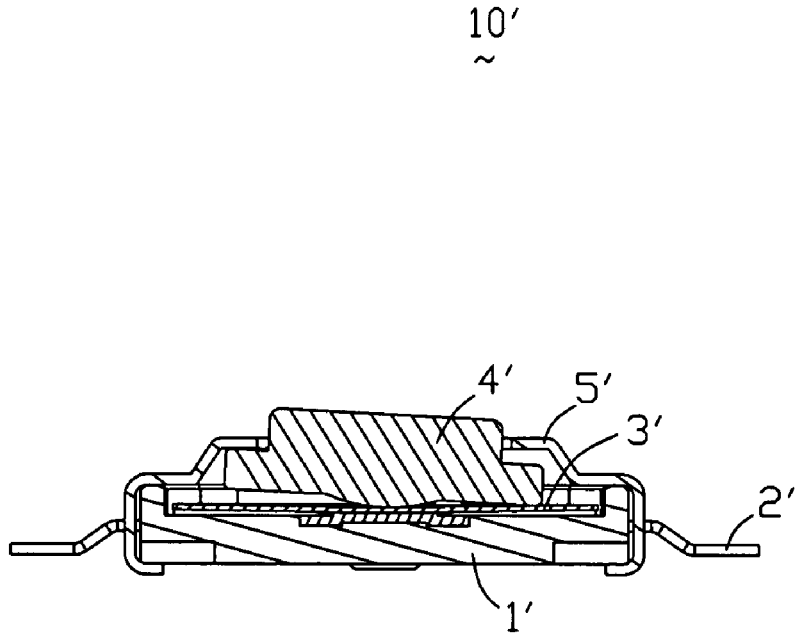
FIG. 9 is a cross-sectional view of the conventional electrical switch.

Referring to FIGS. 1-5, the electrical switch 10 comprises a housing 1, a plurality of stationary contacts 2 embedded in the housing 1, a dome 3 attached onto the stationary contacts 2, a handle 4 disposed onto the dome 3, and a cover 5 with a center opening 511 mounted onto the housing 1.

The housing 1 defines a cavity 11, and the stationary contacts 2 are embedded in the cavity. The stationary contacts 2 include a center stationary contact 231 and a plurality of peripheral stationary contacts 221. The dome 3 is made of elastic metal, and it includes an arcuate central portion 31 and a circular side portion 32. The arcuate center portion 31 covers the center stationary contacts 231 and the side portion 32 contacts with the peripheral stationary contacts 221.

The handle 4 comprises a top operating portion 41, a lower pressing portion 42 for pressing the dome 3, and a middle portion 44 for connecting the operating portion 41 and the pressing portion 42. The middle portion 44 defines a circular top surface 444, a smaller circular lower surface 441, a side surface 442 extending downwardly from edge of the top surface 444, and a connecting portion 443 for connecting the side surface 442 and lower surface 441. The pressing portion 42 protrudes from a center of said lower surface 441 for pressing the arcuate center portion 31 of the dome 3. In this embodiment, the connecting portion 443 is a slanted surface. In other embodiments, the connecting portion 443 can also be one or more step from the lower surface 441.

In assembly, the stationary contacts 2 are firstly embedded in the housing 1, and the dome 3 is then placed into the cavity of the housing 1. The arcuate center portion 31 of the dome 3 covers the center stationary contact 231 and the circular side portion 32 contacts the peripheral stationary contacts 221. The handle 4 attaches to the dome 3 through pressing portion 42. At last, the cover 5 is mounted onto the housing 1, and the top operation portion 41 of the handle 4 extends through the opening 511 of the cover 5.

In use, the handle 4 is pressed downwardly by the operator through the operation portion 41, and the pressing portion 42 presses the center portion 31 of the dome 3. The center portion 31 of the dome 3 deforms downwardly and contacts with the center stationary contact 231, therefore the center stationary contact 231 connects with the peripheral contacts 221 through the metal dome 3, and the predetermined function is achieved.

In the electrical switch of the invention, even if one side of the handle 4 is accidentally pressed and the handle 4 moves downwardly and slants to one side, the connecting portion 443 of the handle 4 will not interfere with the dome 3. Therefore, undesirable operation sense in the conventional switch is avoided, and perfect operation character of the electrical switch can be achieved.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical switch comprising:

a housing defining a cavity;

a plurality of stationary contacts embedded in the housing;

a metal dome received in the cavity and contacting with some of the stationary contacts;

a handle disposed onto the metal dome, the handle comprising a top operating portion, a lower pressing portion for pressing the dome, and a middle portion for connecting the operating portion and the pressing portion;

a cover attached to the housing, the cover defining an opening at a top surface thereof;

wherein the middle portion of the handle defines a top surface and a lower surface, a connecting portion slants upwardly from side of the lower surface for avoiding interfering with the dome during operation of the handle.

2. The electrical switch according to claim 1, wherein the middle portion defines a side surface extending downwardly from edge of the top surface.

3. The electrical switch according to claim 2, wherein the connecting portion interconnects the lower surface and the side surface.

4. The electrical switch according to claim 3, wherein the stationary contacts comprise a center stationary contact and a plurality of peripheral stationary contacts.

5. The electrical switch according to claim 4, wherein the dome comprises an arcuate central portion covering the central stationary contact and a circular side portion contacting with the peripheral stationary contacts.

6. The electrical switch according to claim 5, wherein the dome is made of elastic metal.

7. An electrical switch comprising:

a housing defining a cavity;

a plurality of stationary contacts embedded in the cavity of the housing, the stationary contacts comprising a central stationary contact and a plurality of peripheral stationary contacts;

a metal dome received in the cavity covering the central stationary contact and contacting with the peripheral stationary contacts;

a handle disposed onto the metal dome, the handle comprising a lower surface defining a pressing portion for pressing the dome;

a cover attached to the housing, the cover defining an opening at a top surface thereof;

wherein the handle defines a connecting portion, the connecting portion being apart from the dome during operation of the handle.

8. The electrical switch according to claim 7, wherein the connecting portion is a slanted surface extending upwardly from the lower surface.

9. The electrical switch according to claim 8, wherein the handle defines a vertical side surface, and the slanted connecting portion connects with the side surface at the top end thereof.

10. The electrical switch according to claim 9, wherein the dome comprises an arcuate central portion and a circular side portion, the central portion covers the central stationary contact and the circular side portion contacts with the peripheral stationary contacts.

11. The electrical switch according to claim 10, wherein the dome is made of elastic metal.

12. The electrical switch according to claim 7, wherein the connecting portion is formed with at least one step from the lower surface.

13. An electrical switch comprising:

a housing defining a cavity;

a plurality of stationary contacts extending into the cavity of the housing, the stationary contacts comprising a central stationary contact and at least one peripheral stationary contact;

a metal dome received in the cavity and including a central area covering the central stationary contact and a peripheral area contacting with the peripheral stationary contact;

a handle disposed onto the metal dome, and comprising a lower surface defining a downwardly bulged pressing portion for pressing the dome;

wherein the pressing portion is located at a central region of the lower surface, and a periphery region of the lower surface beside said central region, is configured to have a lower inner section and a higher outer section so as to avoid engagement between the metal dome and the central stationary contact due to any inadvertent tilting of the handle under a condition that the peripheral region by no means presses the peripheral area but always with a gap therebewteen, thus preventing the undesired downward deflection of the central region against the central area which may cause engagement between the central area and the central stationary contact.

14. The electrical switch as claimed in claim 13, wherein the peripheral region defines an upwardly outwardly tapered cross-sectional configuration.

* * * * *